US009193428B2

(12) United States Patent
Reed et al.

(10) Patent No.: US 9,193,428 B2
(45) Date of Patent: Nov. 24, 2015

(54) OAR CARRIER

(71) Applicants: Timothy M. Reed, Gansevoort, NY (US); Timothy S. Reed, Gansevoort, NY (US)

(72) Inventors: Timothy M. Reed, Gansevoort, NY (US); Timothy S. Reed, Gansevoort, NY (US)

( * ) Notice: Subject to any disclaimer, the term of this patent is extended or adjusted under 35 U.S.C. 154(b) by 0 days.

(21) Appl. No.: 14/253,498

(22) Filed: Apr. 15, 2014

(65) Prior Publication Data

US 2014/0312191 A1 Oct. 23, 2014

Related U.S. Application Data

(60) Provisional application No. 61/812,945, filed on Apr. 17, 2013.

(51) Int. Cl.

| | |
|---|---|
| ***A47F 5/00*** | (2006.01) |
| ***B63H 16/04*** | (2006.01) |
| ***B63B 35/73*** | (2006.01) |

(52) U.S. Cl.

CPC ..... *B63H 16/04* (2013.01); *B63B 35/73* (2013.01); *B63B 2035/734* (2013.01)

(58) Field of Classification Search

CPC ..... A47F 5/02; A47B 81/005; F41B 5/066; Y10S 224/916

USPC ..... 248/68.1; 114/343, 364; 211/60.1, 69.8, 211/69.9, 70, 70.6, 95; 440/104

See application file for complete search history.

(56) References Cited

U.S. PATENT DOCUMENTS

| | | | | |
|---|---|---|---|---|
| 2,376,955 | A * | 5/1945 | Ball | 211/60.1 |
| 2,797,851 | A * | 7/1957 | Leake | 224/482 |
| 3,116,730 | A * | 1/1964 | Tingley | 124/24.1 |
| 4,352,337 | A * | 10/1982 | Wyoral | 114/343 |
| 4,453,490 | A * | 6/1984 | Miller | 114/364 |
| 4,777,900 | A | 10/1988 | Abeene et al. | |
| 4,863,082 | A | 9/1989 | Evans et al. | |
| 5,005,509 | A | 4/1991 | Williams | |
| 5,906,304 | A * | 5/1999 | Baldacchino | 224/406 |
| D441,653 | S | 5/2001 | LeRoux | |
| 6,386,377 | B1 * | 5/2002 | Yeoman | 211/60.1 |
| D643,991 | S | 8/2011 | Miller et al. | |
| D659,723 | S | 5/2012 | Hoover | |
| D702,550 | S | 4/2014 | Rendo | |
| 2001/0048053 | A1 | 12/2001 | Donoho | |
| 2010/0116946 | A1 | 5/2010 | Ginsberg | |
| 2011/0290952 | A1 | 12/2011 | Masters et al. | |
| 2014/0312191 | A1 | 10/2014 | Reed et al. | |

OTHER PUBLICATIONS

Non-final Office Action/Restriction issued for related Design U.S. Appl. No. 29/452,509 mailed on Dec. 15, 2014.

Notice of References cited for related Design U.S. Appl. No. 29/452,509 mailed on Dec. 15, 2014.

Non-final Office Action/Quayle Action issued for related Design U.S. Appl. No. 29/452,509 mailed on Feb. 2, 2015.

* cited by examiner

*Primary Examiner* — Gwendolyn Baxter

(74) *Attorney, Agent, or Firm* — Tech Valley Patent, LLC; John Pietrangelo

(57) ABSTRACT

Oar carriers and methods of carrying oars, for example, rowing blades or sculls used by competitive rowing crews. The oar carriers include a panel, through holes in the panel sized to receive a shaft of an oar, and slots in a peripheral surface of the panel providing open access to the through holes to allow transfer of the shaft to the through hole. The slots may have a minimum width less than the diameter of the shaft of an oar, where the slot is made of a resilient material adapted to deflect and allow the diameter of the shaft to transfer to the through hole. One or more handles may be provided to the carrier. Methods of using the oar carrier and arrangements of oars and oar carriers are also disclosed.

19 Claims, 13 Drawing Sheets

OAR CARRIER

CROSS-REFERENCE TO RELATED APPLICATIONS

This application claims priority from U.S. Provisional Patent Application 61/812,945, filed on Apr. 17, 2013, the disclosure of which is included by reference herein in its entirety.

This application is related to U.S. Design patent application Ser. 29/452,509, filed on Apr. 17, 2013, the disclosure of which is included by reference herein in its entirety.

BACKGROUND OF THE INVENTION

1. Technical Field

The present invention generally relates to carriers for rowing oars. More particularly, the present invention relates to carriers for rowing oars having slots adapted to receive the oars and through holes adjoining the slots adapted to receive and retain the oars, for example, for transport or storage.

2. Description of Related Art

In rowing, for example, in competitive rowing, for example, "crew," the participants propel their watercraft, for example, sculls or shells, with oars. As known in the art, the oars or "blades" typically include an elongated shaft having a somewhat flattened oar blade at one end and a handle at the other. Crew oars may typically be quite long, for example, about 250-300 centimeters [cm] (8 to 10 feet [ft]) in length, and may be made from wood or synthetic materials, for example, carbon fiber composite materials.

Due to their length, oars can often be quite unwieldy to handle, for example, to carry, or transport to and from the scull or to and from a rowing competition, that is, a regatta. In addition, when teams of crew members assemble at a regatta, the oars for each of the teams must be arranged and separated to provide each team ready access to their oars, while minimizing oar loss, misplacement, damage, and confusion with the oars of others. Images of collections of oars at regattas are exemplified by the colorful arrangement of oars shown, for example, in FIG. 1.

In addition, oars can be expensive, especially, oars made from carbon fiber composites. Accordingly, though difficult to handle, there is a need to minimize or prevent damaging oars during transport, or during handling at such events as shown in FIG. 1. In addition, as suggested by the image shown in FIG. 1, if not damaged during transport or handling, oars can also be exposed to mud or wet grass that can also negatively impact the performance and/or appearance of the oar.

There exist means in the prior art for storing or displaying oars, for example, as shown by the oar display racks shown in FIG. 2. However, the oar display racks shown in FIG. 2 provide little or no remedy to the issues of handling and storing oars that are exemplified by the oar handling and storage issues that characterize the groups of oars shown in FIG. 1.

Accordingly, there is a need in the art for a means to facilitate the handling of oars, and a means for minimizing or preventing damaging oars either during transport, prior to use, or while in storage. Aspects of the present invention address these needs and other disadvantages of the prior art.

SUMMARY OF THE INVENTION

Aspects of the present invention overcome the limitations of the prior art by providing carriers for oars, that is, oar carriers that provide versatile and convenient means to transport, store, and/or otherwise handle oars. Though aspects of the invention may be uniquely adapted to handle competitive crew oars, other aspects of the invention are adapted to handle any form of oar, including what may be considered "paddles" by some in the art. Aspects of the invention disclosed herein may be marketed under the trademark OARganizer™.

One embodiment of the invention is an oar carrier comprising or including a panel; at least one through hole in the panel, the at least one through hole sized to receive a shaft of an oar; and at least one slot in a peripheral surface of the panel, the at least one slot providing open access to the at least one through hole and the at least one slot adapted to receive the shaft of an oar and allow transfer of the shaft to the through hole. In one aspect, the at least one through hole in the panel may be a plurality of through holes in the panel and the at least one slot may be a plurality of slots.

In one aspect, the at least one slot in the peripheral surface of the panel comprises a plurality of slots in the peripheral surface of the panel, where each of the plurality of slots provides open access to one of the plurality of through holes and each of the plurality of slots adapted to receive the shaft of an oar and transfer the shaft to one of the plurality of through holes. The at least one through hole may be substantially circular through holes, for example, substantially circular through holes sized to receive the shaft of an oar.

In another aspect, the panel may comprise a resilient material, for example, a resilient foam rubber material.

In another aspect, the at least one slot in the peripheral surface of the panel may be a plurality of slots, where each of the plurality of slots have a minimum width less than a diameter of the shaft of the oar. In one aspect, the plurality of slots having a minimum width less than the diameter of the shaft of the oar may be adapted to deflect and allow the diameter of the shaft to transfer to the through hole.

Another embodiment of the invention is a method for handling, for example, carrying, at least one oar, but typically, a plurality of oars. The method comprises or includes: providing a plurality of oar carriers, for example, two oar carriers, as described above; inserting a shaft of the at least one oar into the at least one slot of each of the plurality of carriers; transferring the shaft of the at least one oar through the at least one slot into the at least one through hole in the panel to provide an assembly of the plurality of oar carriers and the at least one oar; and handling the assembly of the plurality of oar carriers and the at least one oar. In one aspect, inserting the shaft of at least one oar into the at least one slot of each of the plurality of carriers may be practiced by inserting the shafts of a plurality of oars into a plurality of slots of each of the plurality of carriers. In another aspect, transferring the shaft of the at least one oar through the at least one slot in to the at least one through hole in the panel may be practiced by deflecting a throat of the at least one slot of each of the oar carriers. This method may further include allowing the deflected throat of the at least one slot of each of the oar carriers to expand and retain the at least one oar in the oar carrier.

A further embodiment of the invention is an arrangement comprising or including: a plurality of oar carriers, for example, two oar carriers, as described above; and at least one oar, the at least one oar having a shaft positioned in a through hole in each of the plurality of oar carriers. In one aspect, the at least one oar comprises a plurality of oars, for example, four oars, wherein each of the plurality of oars having a shaft positioned in the at least one through hole of each of the two oar carriers.

A still further embodiment of the invention is an oar carrier comprising or including a panel at least partially comprising a resilient material; a plurality of through holes in the panel, each of the plurality of through holes sized to receive a shaft of an oar; and a plurality of slots in a peripheral surface of the panel, each of the plurality of slots providing open access through a minimum width of each of the plurality of slots less than a diameter of the shaft of the oar, wherein a portion of the panel having the minimum width of each of the plurality of slots comprises the resilient material adapted to deflect and allow passage of the shaft of the oar to one of the plurality of through holes. In one aspect, the oar carrier further comprises at least one handle, for example, the handle may comprise a through hole in the panel. In another aspect, at least one of the pluralities of slots may have a geometry different from at least one other of the plurality of slots. The geometry different from at least one other of the plurality of slots may be adapted to facilitate handling of the carrier.

These and other aspects, features, and advantages of this invention will become apparent from the following detailed description of the various aspects of the invention taken in conjunction with the accompanying drawings

BRIEF DESCRIPTION OF THE DRAWINGS

The subject matter, which is regarded as the invention, is particularly pointed out and distinctly claimed in the claims at the conclusion of the specification. The foregoing and other objects, features, and advantages of the invention will be readily understood from the following detailed description of aspects of the invention taken in conjunction with the accompanying drawings in which:

DETAILED DESCRIPTION OF THE INVENTION

Figure 3:
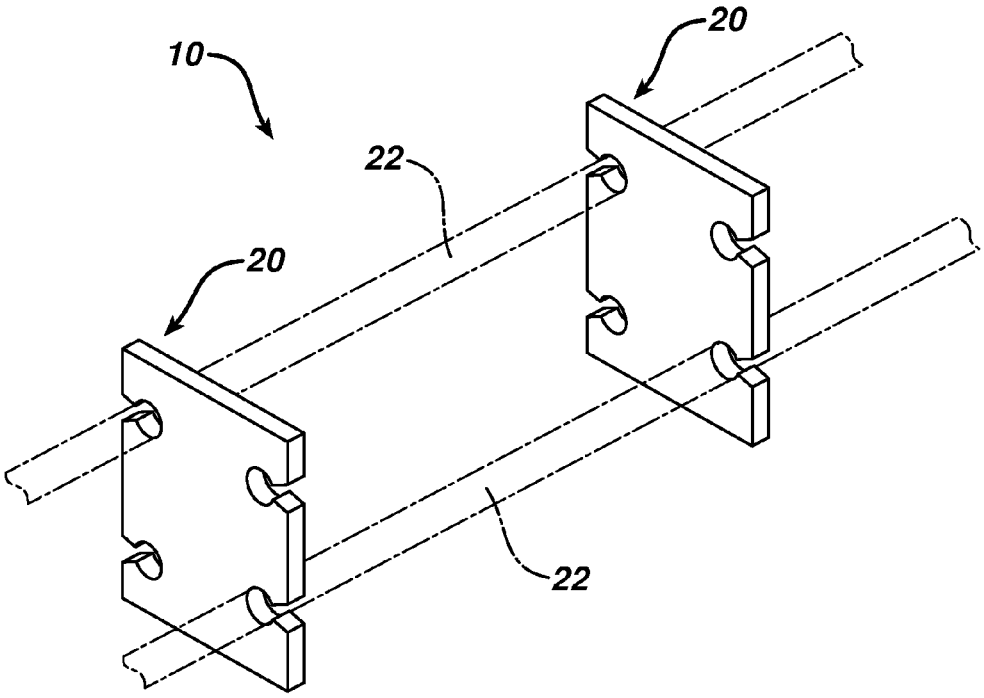
FIG. 3 is a front perspective view of an assembly of oar carriers according to one aspect of the present invention, the rear perspective view being a mirror image thereof.

FIG. 3 is a front perspective view of an assembly 10 of oar carriers 20 and oars 22 (shown partially in phantom) according to one aspect of the present invention. The rear perspective view of assembly 10 is a mirror image of the image shown in FIG. 3. Though two representative oars and two representative oar carriers 20 are shown in FIG. 3, according to aspects of the invention, assembly 10 may include one or more oars 22 and one or more oar carriers 20. Oars 22 may be any oar or paddle, for example, oars 22 may be any oar or paddle used to propel a watercraft, such as, a boat or canoe. However, in one aspect, oars 22 may comprise rowing oars, for example, high performance rowing blades or sculls used by competitive rowing crews, for instance, those marketed by Crocker-USA [http://www.crokerusa.com/], and similar suppliers.

Figure 6:
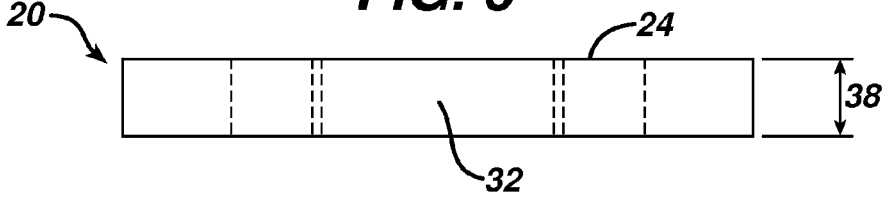
FIG. 6 is a top plan view of the oar carrier shown in FIG. 4, the bottom view being a mirror image thereof.
Figure 4:
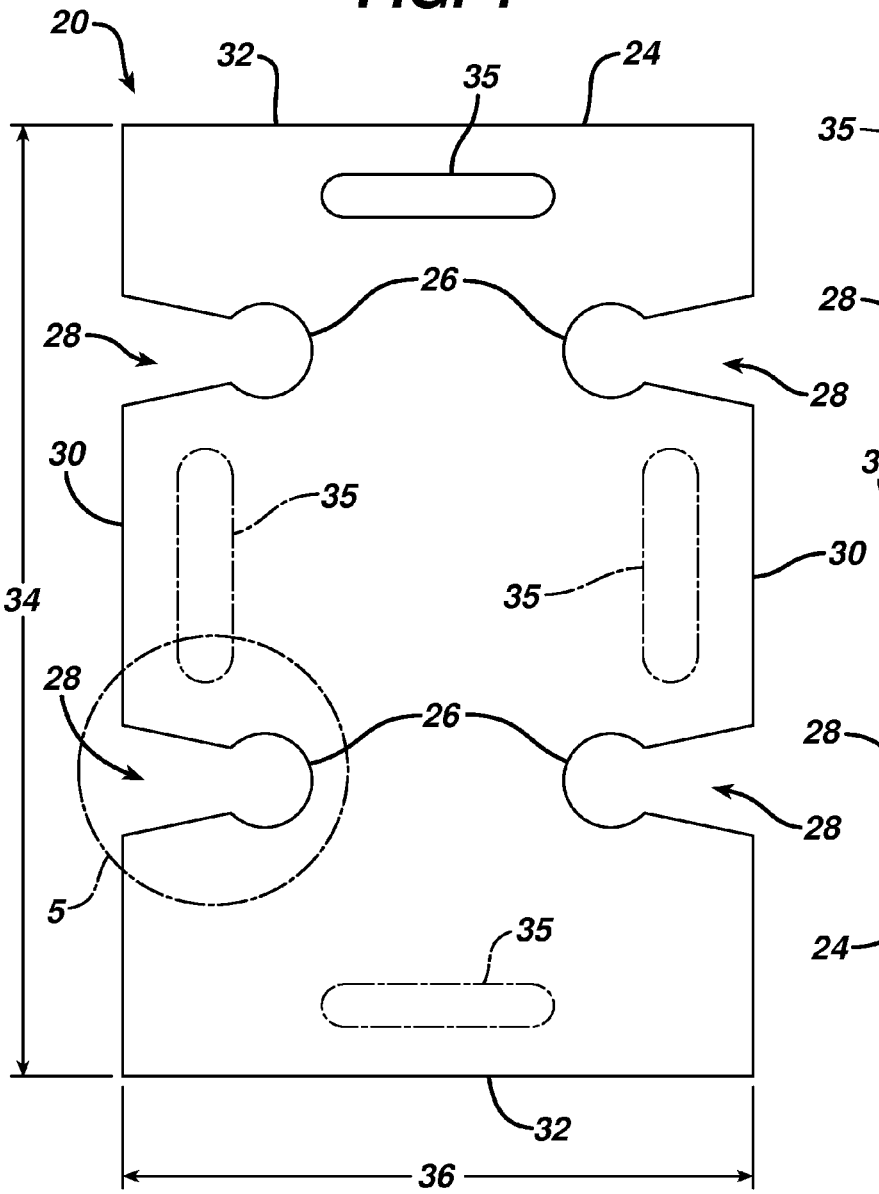
FIG. 4 is a front elevation view of one of the oar carriers shown in FIG. 3.
Figure 5:
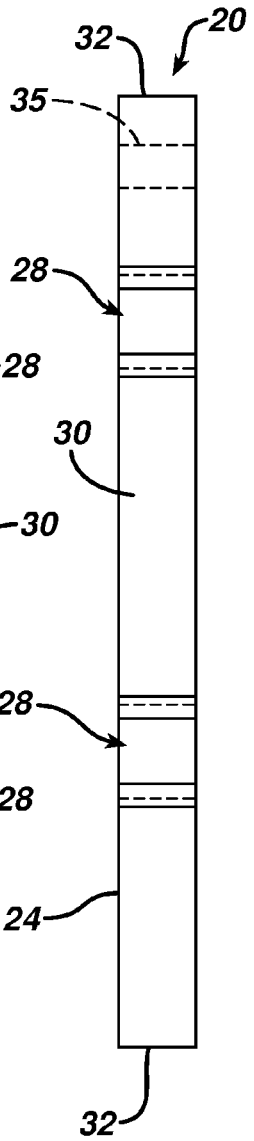
FIG. 5 is a right side elevation view of the oar carrier shown in FIG. 4, the left side elevation view being a mirror image thereof.

FIG. 4 is front elevation view of one of the oar carriers 20 shown in FIG. 3. FIG. 5 is a right side elevation view of the oar carrier 20 shown in FIG. 3. The left side elevation view of the oar carrier 20 is a mirror image of the image shown in FIG. 5. FIG. 6 is a top plan view of the oar carrier 20 shown in FIG. 4. The bottom view of the oar carrier 20 is a mirror image of FIG. 6.

As shown in FIGS. 4, 5, and 6, oar carrier 20 typically comprises a panel 24, at least one through hole 26 in panel 24, where the at least one through hole is sized to receive a shaft of an oar 22 (shown in phantom in FIG. 3), and at least one slot or aperture 28 in a peripheral surface 30 and/or 32 of panel 24. The at least one slot 28 typically provides open access to the at least one through hole 26, and the at least one slot 28 is typically adapted to receive the shaft (not shown) of an oar 22 and allow transfer of the shaft to the through hole 26.

As shown in FIGS. 4, 5, and 6, panel 24 may typically comprise a parallelepiped body having a height 34, a width 36, and a thickness 38. Though panel 24 shown in FIGS. 4, 5, and 6 is generally shown as a solid parallelepiped or solid regular hexahedron (that is, having six faces), panel 24 may comprises a solid or a hollow body—for example, having pores or perforations, such as, to reduce the weight of panel 24. (As will be discussed below, panel 24 may assume a broad range of shapes while providing he desired function disclosed herein.) Panel 24 may comprise a board, a pane, a sheet, or a plate, for example, depending upon the type of material from which panel 24 is made.

According to aspects of the present invention, panel 24 may have height 34 ranging from about 6 inches to about 6 feet, but is typically about 12 inches to about 24 inches in height, for example, about 16.25 inches in height. Panel 24 may have width 36 ranging from about 3 inches to about 3 feet, but is typically about 6 inches to about 18 inches in width, for example, about 9.375 inches in width. Panel 24 may have thickness 38 ranging from about 0.25 inches to about 6 inches, but is typically about 0.5 inches to about 2 in thickness, for example, about 1.25 inches in thickness.

As shown in FIG. 4, the at least one through hole 26 in panel 24 typically comprises a plurality of through holes 26, for example, 2 or more, or four or more through holes 26. Through holes, 26 may be provided in a broad range of cross-sectional shapes, for example, oval, circular, polygonal, such as, square, or pentagonal. However, in the aspect shown in FIG. 4, and in a manner most conducive to the circular cylindrical shape of oar shafts, through holes 26 may typically be circular cylindrical, for example, right circular cylindrical, that is, having a cylindrical axis substantially perpendicular to the plane of the surface of panel 24.

The width or diameter of through holes 26 may vary broadly depending upon the diameter of the shaft of the oar being carried. For example, for a circular through hole 26, the diameter of holes 26 may range from about 1 inch to about 3 inches, for instance, to be adapted to receive an oar having a typical shaft diameter ranging from about 1.25 inches to about 2.5 inches.

Figure 2:
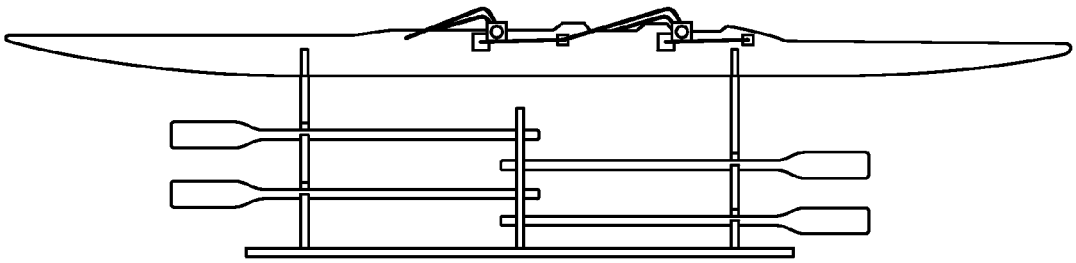
FIG. 2 is a representative view of an oar display rack according to the prior art, over which aspects of the present invention are improvements.

As shown in FIGS. 2, 3, and 4, according to aspects of the invention, panel 24 includes and at least one, but typically, a plurality of slots 28 in peripheral surfaces 30 and 32. In the aspect shown in FIGS. 2, 3, and 4, slots 28 are positioned in lateral peripheral surfaces 30, that is, in the left-hand and in right-hand peripheral surfaces of panel 24, as shown in FIG. 4. However, in one aspect, slots 28 may also be positioned in peripheral surfaces 32, that is, in the top and/or bottom peripheral surfaces 32 of panel 24, as shown in FIG. 4.

As also shown in FIG. 4, panel 24 of carrier 20 may include one or more handles 35 adapted to receive the hand of a user and facilitate grasping and carrying carrier 20. As shown in FIG. 4, handle 35 may be an elongated through hole or slot in panel 35 positioned and shaped to receive the fingers of the hand of a user. As also shown in FIG. 4, the one or more handles 35 (shown in phantom) may be positioned at both ends or at either end of panel 24 (for example, adjacent peripheral surfaces 32). The one or more handles 35 (shown in phantom) may also be positioned at both sides or at either side of panel 24 (for example, adjacent to peripheral surfaces 30).

In one aspect, panels 24, and any panel disclosed herein, may be metallic or non-metallic, for example, panel 24 may be made from one or more conventional structural materials, for example, steel, aluminum, or titanium and the like. However, for ease of handling, panel 24 may typically made from a non-metallic material, for example, a rubber, a plastic, or even wood, typically, a hardwood. In one aspect, the material from which panel 24 is made may be a resilient material, for example, a flexible or elastic material which allows at least some deformation to occur under load without permanently damaging or distorting the shape of the panel. In one aspect, panel 24 may be made from one or more of the following plastics: a polyamide (PA), for example, nylon; a polyethylene (PE); a polypropylene (PP); a polyester (PE); a polytetrafluoroethylene (PTFE); an acrylonitrile butadiene styrene (ABS); a polycarbonate (PC); or a polyvinylchloride (PVC), among other plastics. In another aspect, panel 24 may be made from one or more of the following rubbers: a natural polymer, such as, polyisoprene rubber, or a synthetic polymer, such as, a neoprene, a thermoplastic elastomer, a thermoplastic rubber, and a polyvinyl chloride, or an ethylene propylene diene monomer (EPDM) rubber, and the like.

In one aspect, panel 24 may be made from a foam-based material, for example, foam rubber or expanded rubber, such as, neoprene foam, polyurethane foam, or latex foam; or a foam plastic, such as, polyethylene foam. In one aspect, the foam-based material may comprise an open-cell foam or a closed-cell foam, such as, a mini-cell foam rubber. In another aspect, the foam material may be a cross-linked foam rubber, for example, a cross-linked, mini-cell foam rubber, such as, ethylene vinyl acetate (EVA) foam rubber, or its equivalent.

Figure 7:
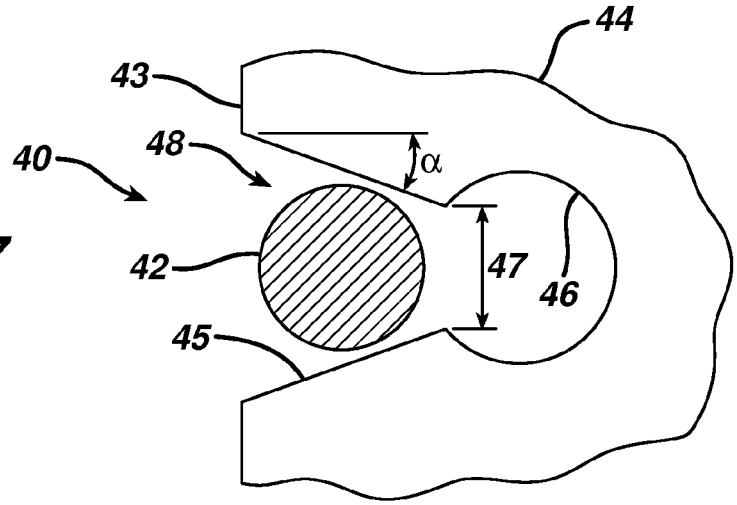
FIGS. 7 through 9 are detailed views of one slot and through whole geometry of the oar carrier shown in FIG. 4, sequentially illustrating the engagement of an oar, according to one aspect of the invention.
Figure 8:
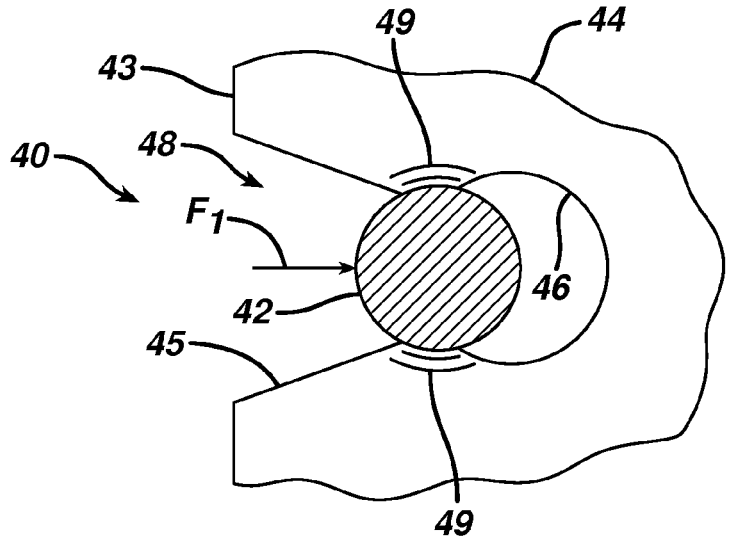
Figure 9:
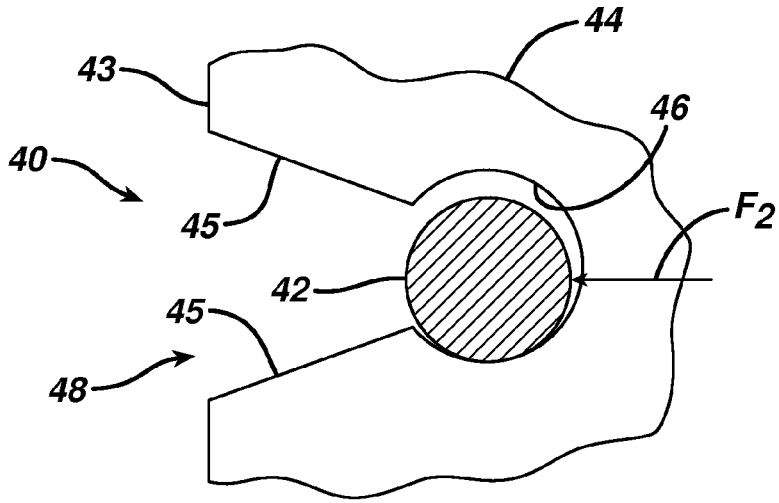

FIGS. 7 through 9 are detailed views of one through hole and slot geometry 40 that may be used for holes 26 and slots 28 of the oar carrier shown in FIG. 4. FIGS. 7 through 9 sequentially illustrate the engagement of an oar shaft 42 (shown in cross section) of an oar with a peripheral side 43 of a panel 44 according to one aspect of the invention. As shown in FIGS. 7, 8, and 9, hole and slot geometry 40 includes a through hole 46 and a slot 48 in peripheral side 43 of panel 44. As shown, hole 46 may typically be larger in width or diameter than the outside width or outside diameter of oar shaft 42. Through hole 46 may have the features and characteristics of hole 26 shown and described with respect to FIGS. 4 through 6.

As shown in FIG. 7, according to one aspect of the invention, slot 48 in panel 44 may have at least one tapering side 45, for example, two tapering sides 45, that converge to a narrower opening or throat 47. The angle $\alpha$ of the taper of sides 45, for example, with respect to the horizontal plane, for instance, as defined by the plane of the bottom surface of the panel 44, may range from about 5 degrees to about 50 degrees; however, the angle $\alpha$ may typically range from about 15 to about 30 degrees. In one aspect, the width of throat 47 may be less than or greater than the outside width or diameter of the shaft 42 of the oar.

In one aspect, as shown in FIG. 7, the width of throat 47 may be less than the width or diameter of the shaft 42 of the oar. According to this aspect, the difference in width of throat 47 may be used as a means for retaining oar shaft 42 in hole 46. As shown most clearly in FIG. 8, the width of throat 47 may be less than the outside diameter of oar shaft 42 where oar shaft 42 cannot pass through throat 47 without some deflection of at least one of the extremities of throat 47. As noted earlier, in one aspect of the invention, panels 24 and 44 may be made from a resilient material, for example, from foam rubber. As shown in FIGS. 8 and 9, the resiliency (or the ability to deform elastically) of panel 24 allows the oar shaft 42 (typically comprising a relatively rigid material) when under load (for example, as indicated by force $F_1$ on oar shaft 42 in FIG. 8) to deflect the extremities of throat 47, as indicated by strain marks 49. The deflection of panel 24 under load allows oar shaft 42 to pass through throat 47 and into hole 46, as shown in FIG. 9. Accordingly, in one aspect of the invention, as shown in FIG. 9, oar shaft 42 may be retained in hole 46 by the restriction of the narrow throat 47, unless a force $F_2$ (similar or greater in magnitude to force $F_1$) is exerted upon oar shaft 42 and again the extremities of throat 47 are deflected (not shown in FIG. 9, but similar to that shown in FIG. 8 by strain marks 49.)

Figure 10:
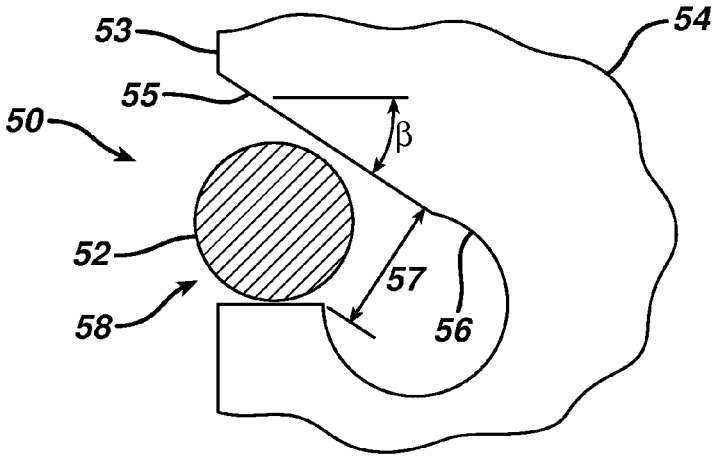
FIGS. 10 through 12 are detailed views of another slot and through hole geometry of the oar carrier shown in FIG. 4, sequentially illustrating the engagement of an oar, according to one aspect of the invention.
Figure 11:
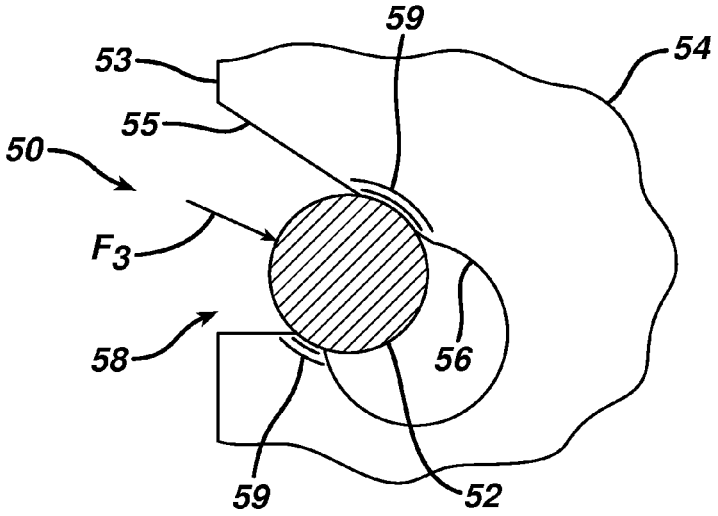
Figure 12:
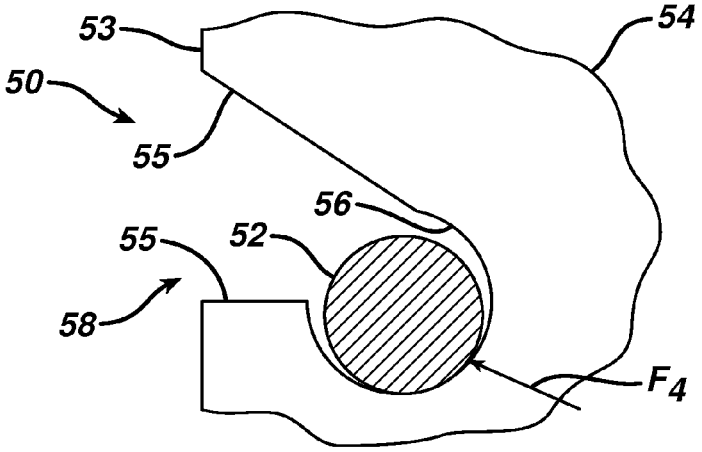

FIGS. 10 through 12 are detailed views, similar to FIG. 7 through nine, of another through hole and slot geometry 50 that may be used for holes 26 and slots 28 of the oar carrier shown in FIG. 2. FIGS. 10 through 12 also sequentially illustrate the engagement of an oar shaft 52 (shown in cross section) of an oar with a peripheral side 53 of a panel 54 according to another aspect of the invention. As shown in FIGS. 10, 11, and 12, hole and slot geometry 50 includes a through hole 56 and a slot 58 in a peripheral side 53. As shown, hole 56 may typically be larger in width or diameter than the outside width or outside diameter of oar shaft 52.

Through hole 56 may have the features and characteristics of hole 26 shown and described with respect to FIGS. 4 through 6.

As shown in FIG. 11, according to one aspect of the invention, slot 58 in panel 54 may have at least one tapering side 55, for example, one tapering side 55 and one non-tapering side 55, that converge to a narrower opening or throat 57. The angle β of taper of sides 55, for example, with respect to the horizontal plane, for instance, as defined by the plane of the bottom surface of the panel 54, may range from about 5 degrees to about 75 degrees; however, the angle β may typically range from about 30 to about 60 degrees, for example, about 35 degrees. In one aspect, the width of throat 57 may be less than or greater than the outside width or diameter of the shaft 52 of the oar.

In one aspect, as shown in FIG. 12, the width of throat 57 may be less than the width or diameter of the shaft 52 of the oar. According to this aspect, the difference in width of throat 57 may be used as a means for retaining oar shaft 52 in hole 56. As shown most clearly in FIG. 12, the width of throat 57 may be less than the outside diameter of oar shaft 52 where oar shaft 52 cannot pass through throat 57 without some deflection of at least one of the extremities of throat 57. As noted earlier, in one aspect of the invention, panels 24 and 44 may be made from a resilient material, for example, foam rubber. As shown in FIGS. 11 and 12, the resiliency (or the ability to deform elastically) of panel 54, allows the oar shaft 52 (typically comprising a relatively rigid material) when under load (for example, as indicated by force $F_3$ on oar shaft 52 in FIG. 11) to deflect the extremities of throat 57, as indicated by strain marks 59. The deflection of panel 24 under load allows oar shaft 52 to pass through throat 57 and into hole 56, as shown in FIG. 12. Accordingly, in one aspect of the invention, as shown in FIG. 12, oar shaft 52 may be retained in hole 56 by the restriction of the narrow throat 57, unless a force $F_4$ (similar or greater in magnitude to force $F_3$) is exerted upon oar shaft 52 and again the extremities of throat 57 are deflected (not shown in FIG. 12, but similar to that shown in FIG. 11 by strain marks 59.)

Through, in one aspect of the invention, substantially the entire panels 44 and 55 in FIGS. 7 through 9 and FIGS. 10 through 12, respectively, may comprise a resilient material, in another aspect, only portions of panels 44 and 55 may comprise a resilient material. For example, in one aspect, only the portions of the panels about throats 47 and 57 may comprise a resilient material, where the portions around the throats 47 and 57 may deflect or deform to allow passage of oar shaft 42 and 52, respectively. In one aspect, one or more portions of panels 44 and 55 may comprise a relatively non-resilient material, for example, a rigid plastic, a wood, or a metal, and the portions about the throats 47 and 57 and/or the through holes 46 and 56, and/or the slots 48 and 58 may comprise a resilient material, such as, a foam rubber. In one aspect, the resilient material about throats 47 and 57 may be provided by inserts made of resilient material, for example, inserts that may be replaceable, for instance, due to damage or excessive wear. In addition, the resilient material, for example, about throats 47 and 57, may be provided by inserts made of resilient material, for example, inserts that may be replaceable, for instance, due to damage or excessive wear. In another aspect, holes 46 and 56 and slots 48 and 58 may be provided by inserts of one material, for example, a more resilient material, and the remainder of panels 44 and 54 may comprise another material, for example, a less resilient material. Again, the inserts comprising holes 46 and 56 and slots 48 and 58 may be replaceable, for instance, due to damage or excessive wear. In another aspect, a replaceable insert of resilient material may be provided for when a material of a different resilience is desired, for instance, to vary the insertion and/or removal force required, for example, having an insert with more resilience when the oar carrier 20 is used by children and an insert of less resilience when the oar carrier 20 is used by adults.

FIGS. 13 through 23 are plan views of various panel shapes according to aspects of the invention. According to aspects of the invention, the type and location of slots and holes about the panels shown, for example, hole and slot arrangements 40 and 50 shown in FIGS. 7 through 9 and 10 through 12, respectively, may vary broadly. However, in FIGS. 13 through 23 hole and slot arrangements are shown in phantom by representative holes.

Figure 13:
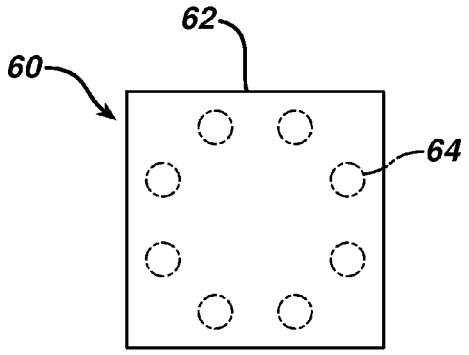
FIGS. 13 through 24 are plan views of various panel shapes according to aspects of the invention.
Figure 14:
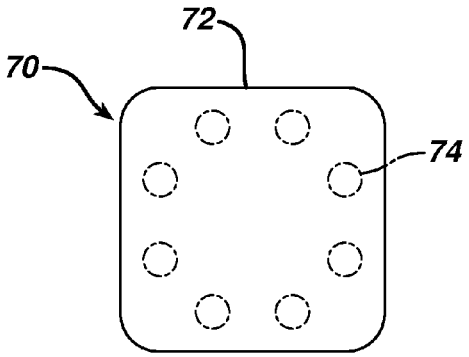
Figure 15:
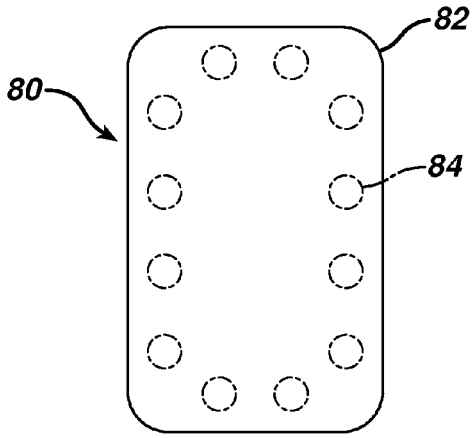
Figure 16:
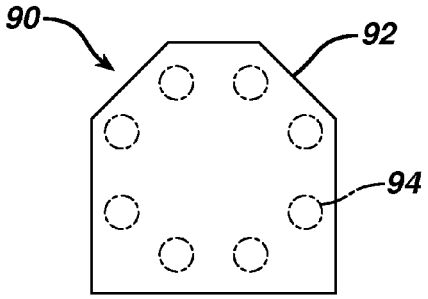
Figure 17:
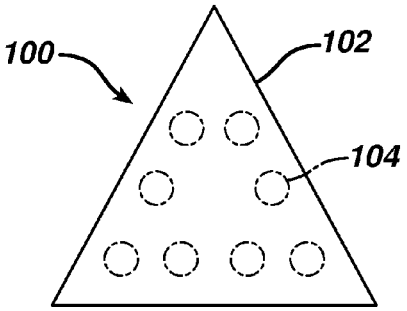
Figure 18:
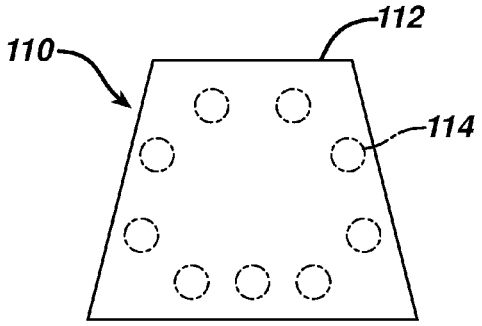
Figure 19:
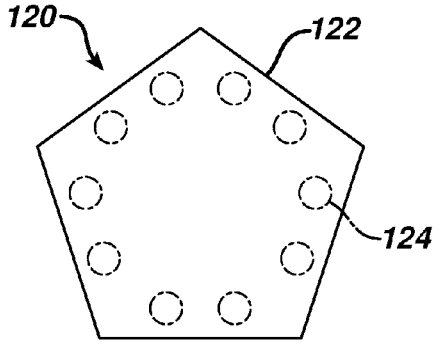
Figure 20:
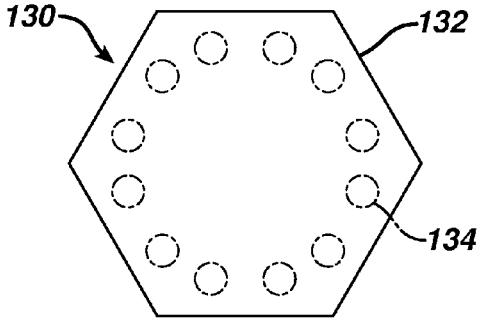
Figure 21:
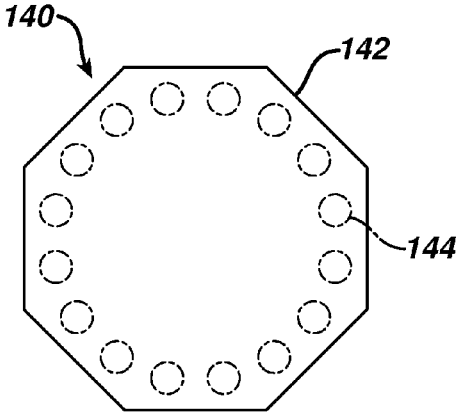
Figure 22:
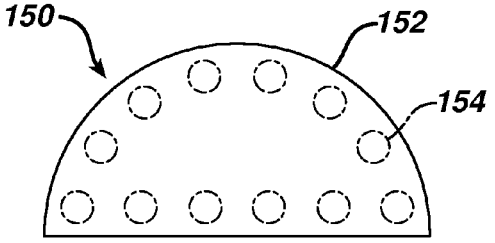
Figure 23:
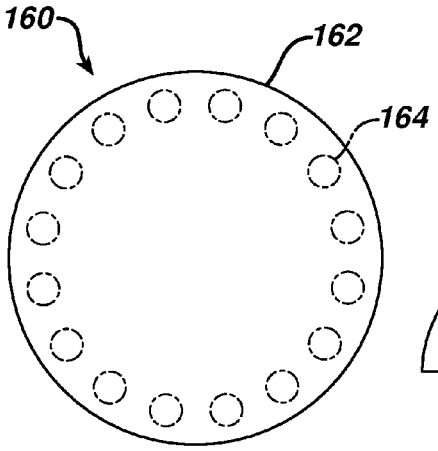
Figure 24:
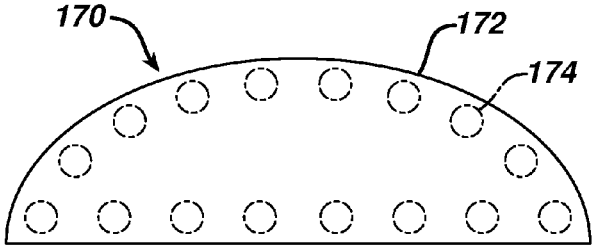

FIG. 13 illustrates an oar carrier 60 having a square panel 62 having one or more hole and slot arrangements 64. FIG. 14 illustrates an oar carrier 70 having a square panel 72 with rounded corners having one or more hole and slot arrangements 74. FIG. 15 illustrates an oar carrier 80 having a rectangular panel 82 having sharp or rounded corners and having one or more hole and slot arrangements 84. FIG. 16 illustrates an oar carrier 90 having a pentagonal panel 92 having sharp or rounded corners and having one or more hole and slot arrangements 94. FIG. 17 illustrates an oar carrier 100 having a triangular panel 102 having sharp or rounded corners and having one or more hole and slot arrangements 104. FIG. 18 illustrates an oar carrier 110 having a trapezoidal panel 112 having sharp or rounded corners and having one or more hole and slot arrangements 114. FIG. 19 illustrates an oar carrier 120 having a pentagonal panel 122 having sharp or rounded corners and having one or more hole and slot arrangements 124. FIG. 20 illustrates an oar carrier 130 having a hexagonal panel 132 having sharp or rounded corners and having one or more hole and slot arrangements 134. FIG. 21 illustrates an oar carrier 140 having an octagonal panel 142 having sharp or rounded corners and having one or more hole and slot arrangements 144. FIG. 22 illustrates an oar carrier 150 having a semi-circular panel 152 having one or more hole and slot arrangements 154. FIG. 23 illustrates an oar carrier 160 having a circular panel 162 having one or more hole and slot arrangements 164. FIG. 24 illustrates an oar carrier 170 having a semi-elliptical panel 172 having one or more hole and slot arrangements 174. The oar carriers shown in FIGS. 13 through 24 may comprise one or more of the materials disclosed herein and may conform to the range of dimensions disclosed for other aspects of the invention disclosed herein. Those of skill the art will recognize that the shapes of the panels disclosed herein are not exhaustive. Further shapes for panels may be provided, though not shown, according to aspects of the present invention.

Figure 25:
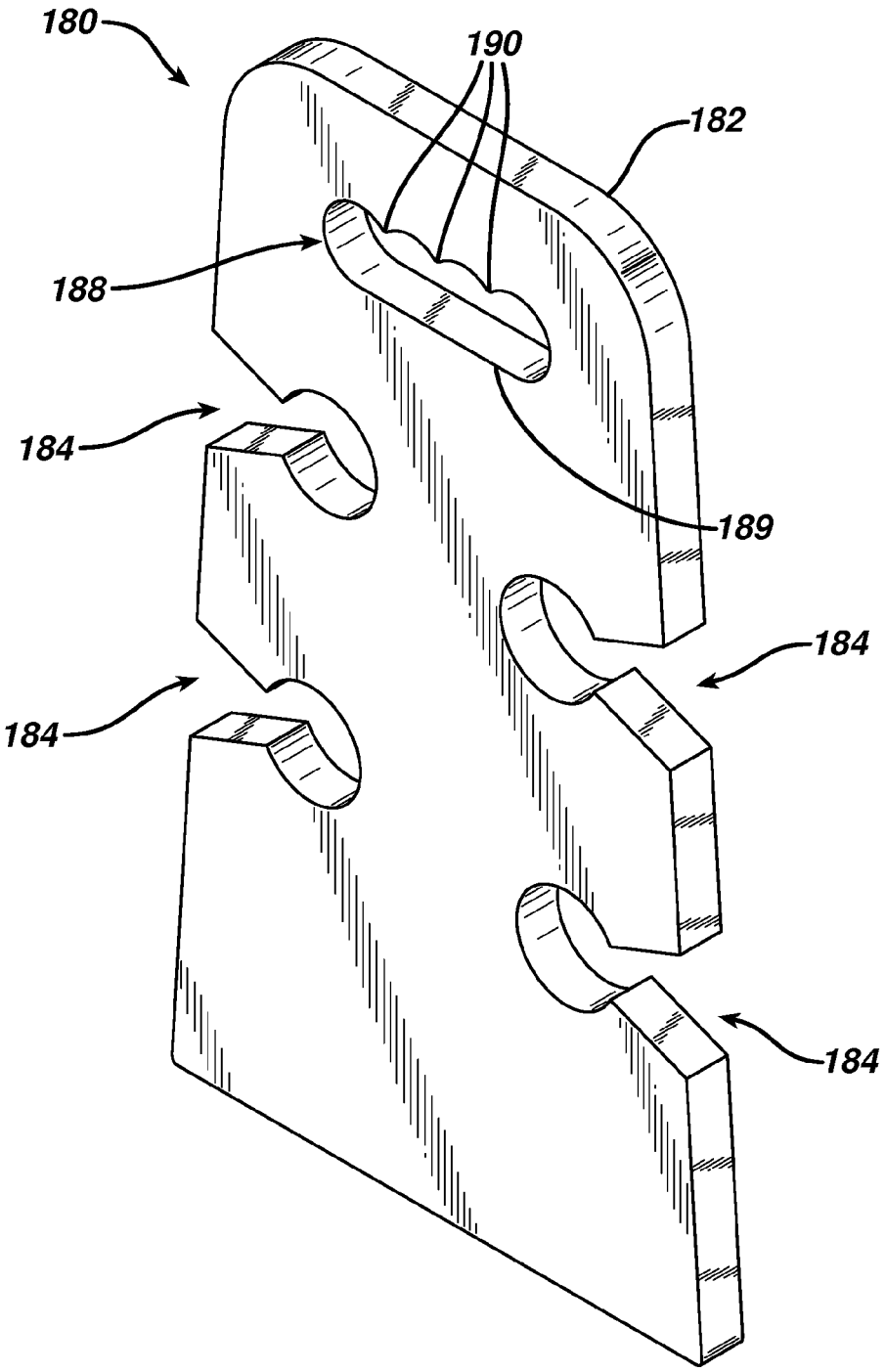
FIG. 25 is a front perspective view of an oar carrier according to another aspect of the invention.

FIG. 25 is a front perspective view of an oar carrier 180 according to another aspect of the invention. As shown in FIG. 25, oar carrier 180 includes a panel 182 and a plurality of hole and slot arrangements 184. However, any hole and slot arrangement disclosed herein may be used for oar carrier 180, in the aspect shown, oar carrier 180 includes a hole and slot arrangement similar to hole and slot arrangement 50 shown in FIGS. 10 through 12. Oar carrier 180 may comprise any one or more of the materials disclosed herein and may conform to the range of dimensions disclosed for other aspects of the invention disclosed herein. For example, in one aspect, oar carrier 180 may be made from a mini-cell polyethylene foam rubber; oar carrier 180 may have a thickness ranging from about 1 inch to about 2 inches, for example, about 1.25 inches; a height ranging from about 10 inches to about 24 inches, for example, about 16.5 inches; and a width at its base ranging from about 6 inches to about 18 inches, for example, about 9.375 inches.

Figure 29:
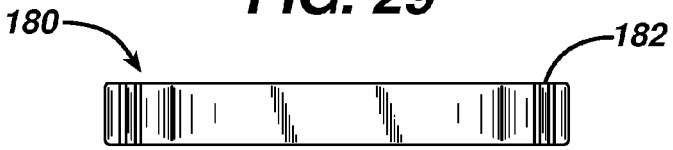
FIG. 29 is a top plan view of the oar carrier shown in FIG. 26.
Figure 28:
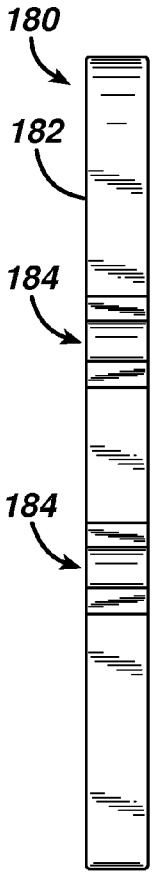
FIG. 28 is a left side elevation view of the oar carrier shown in FIG. 24.
Figure 26:
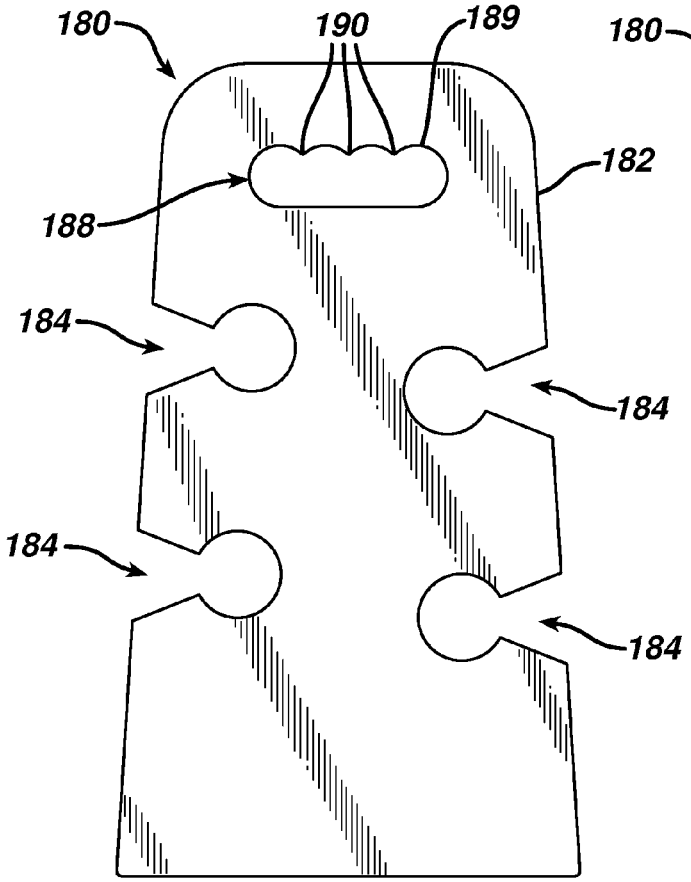
FIG. 26 is a front elevation view of the oar carrier shown in FIG. 25, the rear elevation view being a mirror image thereof.
Figure 27:
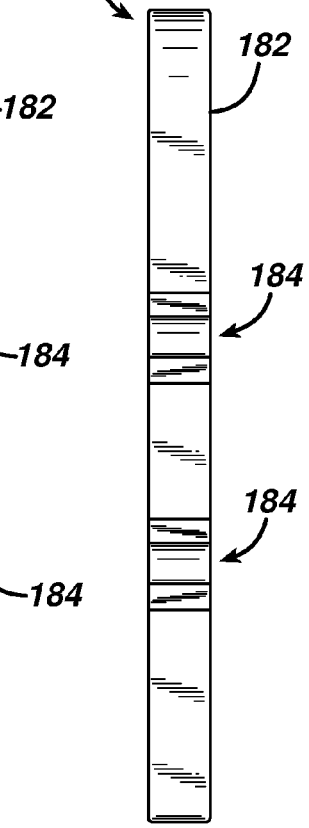
FIG. 27 is a right side elevation view of the oar carrier shown in FIG. 26.
Figure 30:
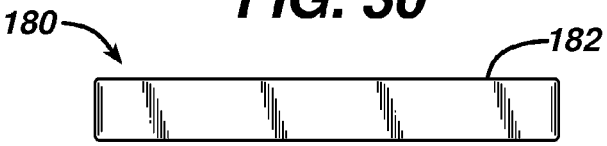
FIG. 30 is a bottom view of the oar carrier shown in FIG. 26.

FIG. 26 is a front elevation view of the oar carrier 180 shown in FIG. 23, while the rear elevation view of oar carrier 180 is substantially a mirror image of the illustration shown in FIG. 26. FIG. 27 is a right side elevation view and FIG. 28 is a left side elevation view of oar carrier 180 shown in FIG. 26. FIG. 29 is a top plan view of oar carrier 180 and FIG. 30 is a bottom view of oar carrier 180 shown in FIG. 26.

As also shown in FIGS. 25 through 30, the oar carrier 180 typically includes one or more handles 188 to facilitate handling and carrying of oar carrier 180. In this aspect, handle 188 comprises an elongated through hole 189 in panel 182 having rounded ends and a plurality of gripping ridges 190. The gripping ridges are positioned and adapted to engage the fingers of the user or handler of carrier 180. Though in the aspect shown in FIG. 26 handle 188 comprises a through hole in panel 182, for example, a through hole in a resilient material, according to one aspect, handle 188 may comprise an insert in panel 182 of a different material from the material of another portion or the remainder of panel 182. For example, handle 188 may comprise an insert comprising a less resilient or a rigid material to provide at least some structural strength or wear resistance to the handle 188. For instance, in one aspect, panel 182 may comprise a foam rubber material and handle 188 may comprise a rigid plastic insert, for example, an ABS plastic insert, adapted to conform to the foam rubber material while providing the desired handle function to oar carrier 180.

Figure 1:
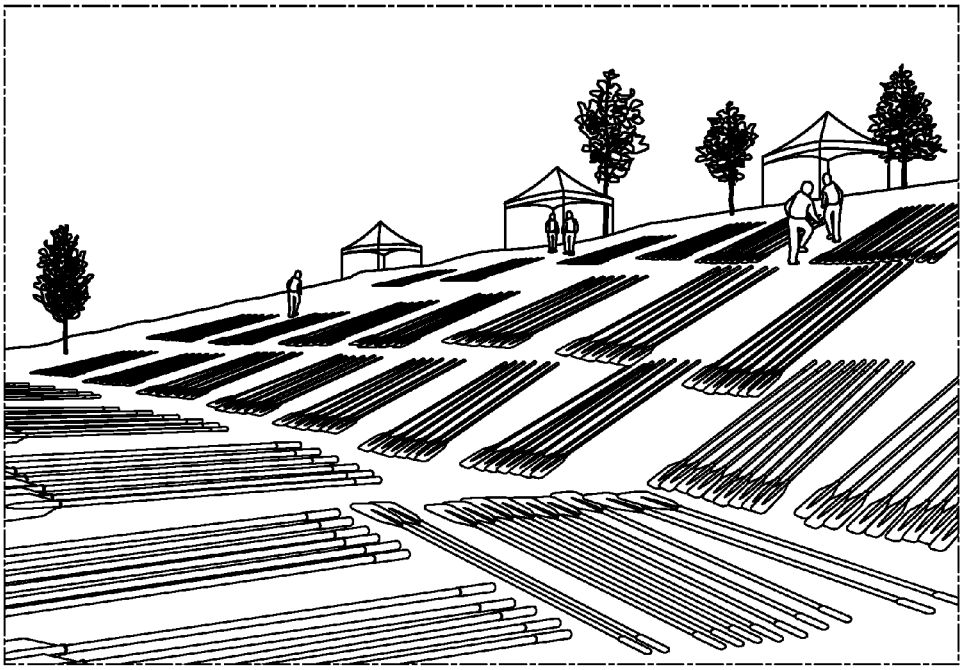
FIG. 1 is a representative view of a multitude of oars that may be seen at a rowing event according to the prior art, over which aspects of the present invention are improvements.
Figure 31:
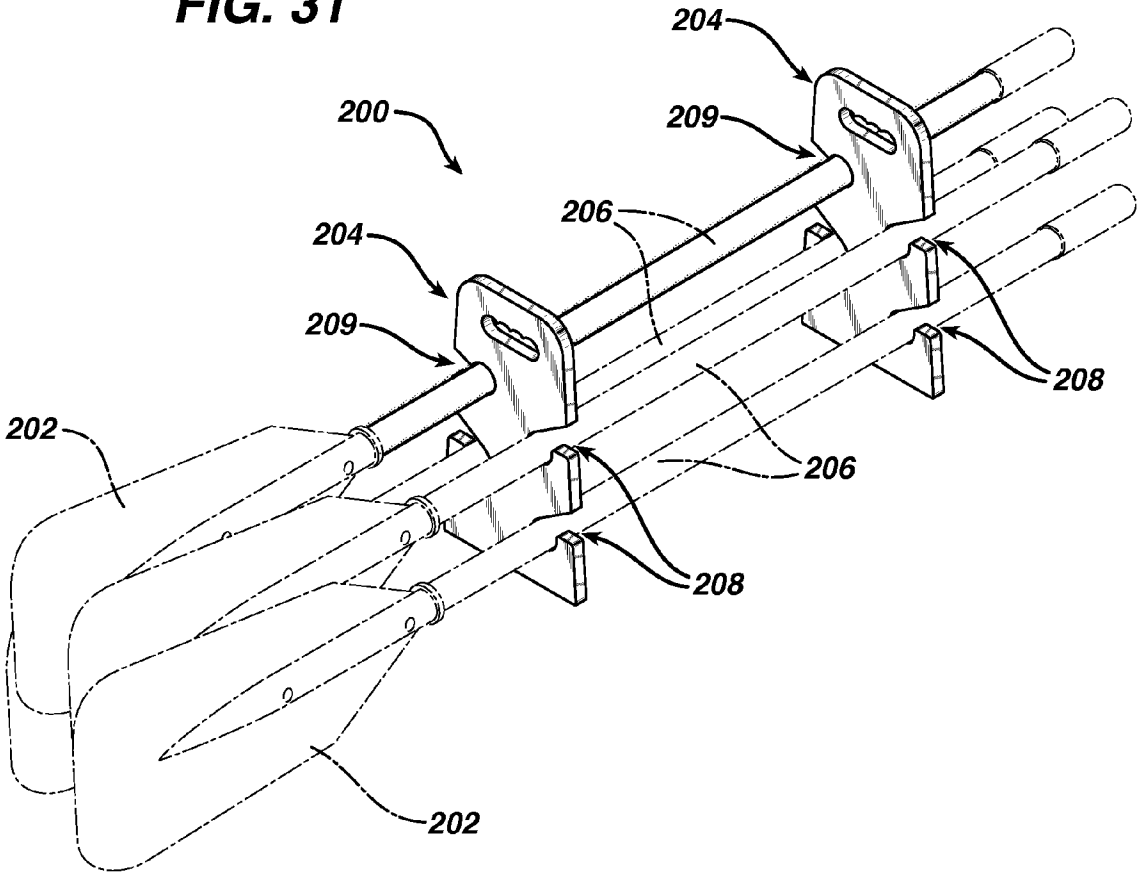
FIG. 31 is a front perspective view of an assembly of oars and oar carriers according to another aspect of the invention.

FIG. 31 is a front perspective view of an assembly 200 of oars 202 and oar carriers 204 according to another aspect of the invention. As shown, as is typical of aspects of the invention, oars 202 include oar shafts 206, wherein oar shafts 206 engage slot and hole arrangements 208 in oar carriers 202 as shown and described herein. It is believed that the assembly 200 shown in FIG. 31 clearly illustrates the benefits and advantages of aspects of the present invention, for example, especially compared to the typical handling of oars represented in FIG. 1.

As suggested by FIG. 31, oar carriers 204 (and any oar carriers disclosed herein) provide a compact arrangement for carrying, storing, and otherwise handling oars 202, for example, by one or two handlers grasping and lifting assembly 200 by the handles in carriers 204. In another aspect, assembly 200 may be handled by one or more handlers grasping the shafts 206 of one or more oars 202 shown in FIG. 29. For example, the shafts 206 of oars 202 in assembly 200 may be used for grasping and carrying assembly 200. In one aspect, the slots and through holes in oar carriers 204 may be adapted to facilitate handling of assembly 200 by shafts 206. For example, at least one of the slots and through holes in carriers 204 used to engage an oar 202 having a shaft 206, which may be used to carry assembly 200, may comprise the through hole and slot geometry 40 shown in FIGS. 7 through 9, as indicated by slot and hole arrangements 209 in oar carriers 202 in FIG. 31. The through hole and slot geometry 40 of one or more slot and hole arrangements 209 may be more conducive to retaining a shaft 206 when carried by a handler or user, for instance, may retain oar shaft 206 more snugly or securely and minimize disengagement in comparison to through hole and slot geometry 50 shown in FIGS. 10 through 12, which may not be as conducive to retaining a shaft 206 in assembly 200 when carried by a handler.

In addition, aspects of the invention may minimize the contact with and damage from adjacent surfaces, such as, muddy ground or wet grass, to avoid damaging, soiling, or otherwise detracting from the performance, appearance, and cleanliness of oars 202. Further benefits and advantages of aspects of the present invention will be apparent to those of skill in the art, including crew members, their coaches, equipment managers, and regatta organizers, and the like.

Figure 32:
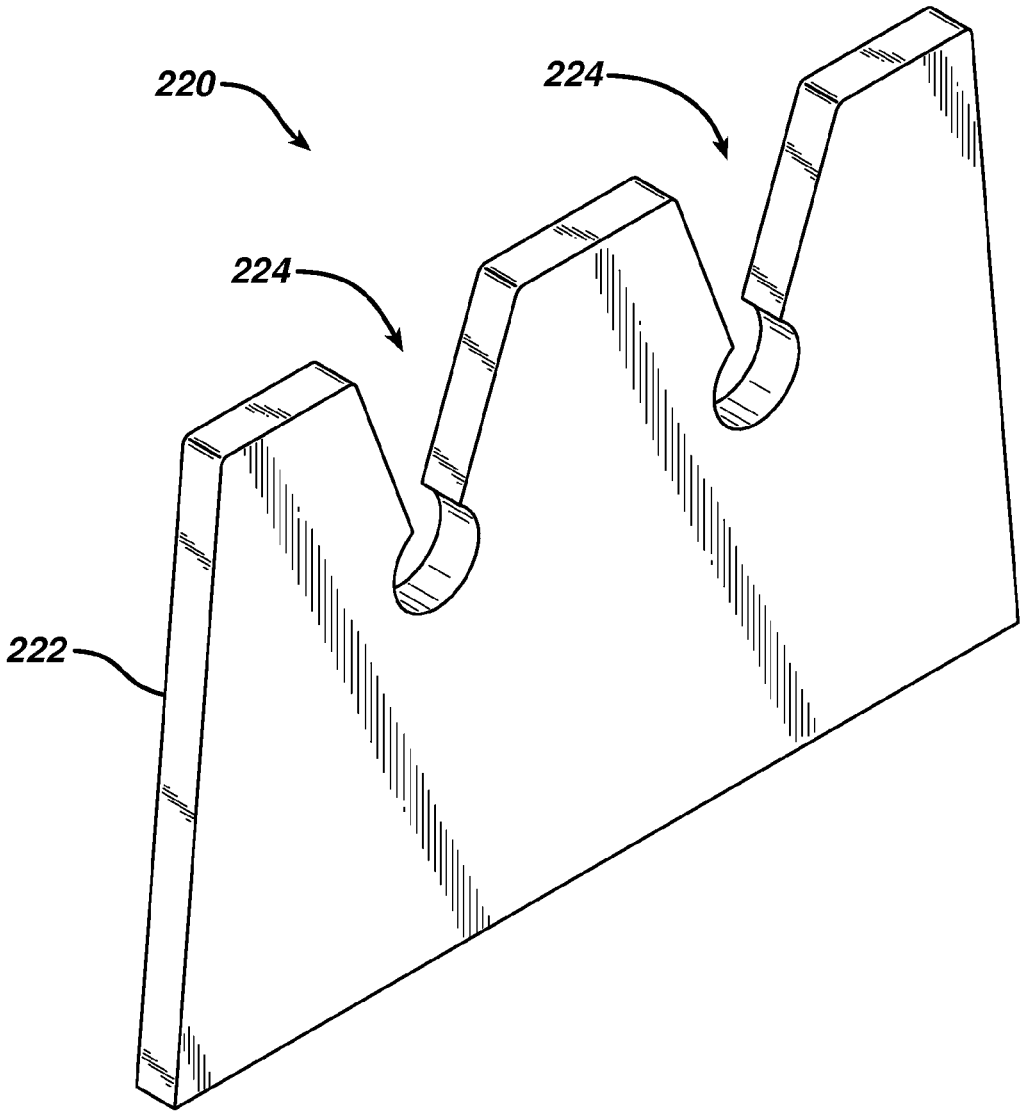
FIG. 32 is a front perspective view of an oar carrier according to another aspect of the invention.
Figure 35:
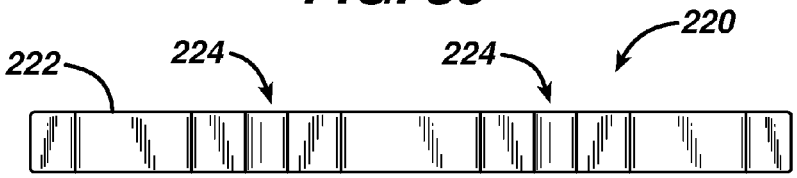
FIG. 35 is a top plan view of the oar carrier shown in FIG. 33.
Figure 33:
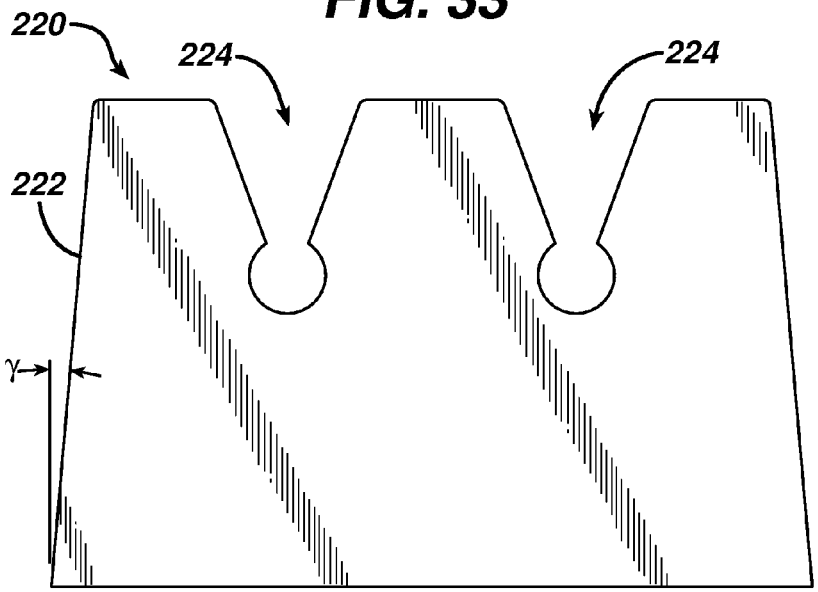
FIG. 33 is a front elevation view of the oar carrier shown in FIG. 32, the rear elevation view being a mirror image thereof.
Figure 34:
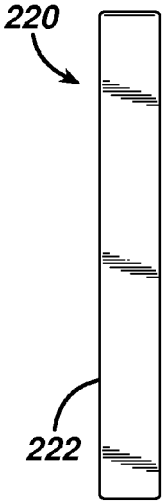
FIG. 34 is a right side elevation view of the oar carrier shown in FIG. 33, a left side elevation view being a mirror image thereof.
Figure 36:
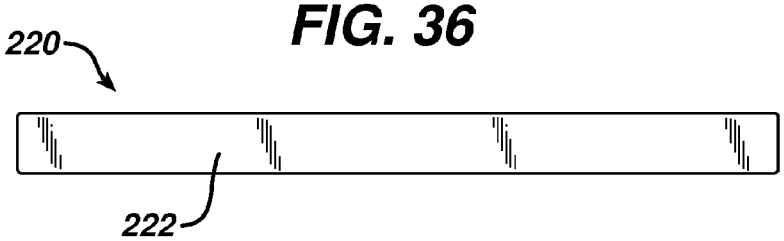
FIG. 36 is a bottom view of the oar carrier shown in FIG. 33.

FIG. 32 is a front perspective view of an oar carrier 220 according to another aspect of the invention. FIG. 33 is a front elevation view of the oar carrier 220 shown in FIG. 32, while the rear elevation view of oar carrier 220 is substantially a mirror image of the illustration shown in FIG. 33. FIG. 34 is a right side elevation view, while the left side elevation view of oar carrier 220 is substantially a mirror image of the illustration shown in FIG. 34. FIG. 35 is a top plan view of oar carrier 220 and FIG. 36 is a bottom view of oar carrier 220 shown in FIG. 33.

As shown in FIGS. 32 through 36, oar carrier 220 includes a panel 222 and a plurality of hole and slot arrangements 224. Though any hole and slot arrangement disclosed herein may be used for oar carrier 220, in the aspect shown, oar carrier 220 includes a hole and slot arrangements similar to hole and slot arrangement 40 shown in FIGS. 7 through 9. Oar carrier 220 may comprise any one or more of the materials disclosed herein and may conform to the range of dimensions disclosed for other aspects of the invention disclosed herein. For example, in one aspect, oar carrier 220 may be made from a mini-cell polyethylene foam rubber; oar carrier 220 may have a thickness ranging from about 1 inch to about 2 inches, for example, about 1.25 inches; a height ranging from about 6 inches to about 24 inches, for example, about 8 inches; and a width at its base ranging from about 6 inches to about 24 inches, for example, about 12.5 inches.

The panel 222 of oar carrier 220 typically comprises a trapezoidal shape, for example, having a taper angle $\gamma$. Taper angle $\gamma$ from about 1 degree to about 45 degrees, but may typically range from about 3 degrees to about 10 degrees, for example, about 5 degrees. Though oar carrier 220 is shown having two hole and slot arrangements 224, oar carrier 220 may have one or more hole and slot arrangements 224, for example, three (3) hole and slot arrangements 224 or four (4) hole and slot arrangements 224, or more. Regardless of the number, hole and slot arrangements 224 may be evenly spaced along a side of panel 222.

Though not shown in FIGS. 32 through 36, the oar carrier 220 may include one or more handles (not shown) to facilitate handling and carrying of oar carrier 220, for example, handles located and shaped in a fashion similar to handle 188 shown in FIG. 26. In addition, in one aspect, any handles in oar carrier 220 may comprise an insert in panel 222 of a different material from the material of another portion or the remainder of panel 222.

It is also conceived that aspects of the invention may be used or adapted for any item having an elongated structure, for example, any item having an elongated shaft, rod, or pole. For example, it is envisioned that aspects of the invention may also be used or adapted for sporting goods, for example, baseball bats, fishing rods, golf clubs, ice hockey sticks, field hockey sticks, lacrosse sticks, tennis rackets, javelins, pole vaulting poles, and the like; or tools, for example, shovels, hoes, rakes, axes, picks, mallets, adzes, saws, and the like. In one aspect, a sporting goods carrier, for instance, a baseball bat carrier is provided as disclosed herein for an oar. In another aspect, a tool carrier, for example, a shovel carrier, is provided as disclosed herein for an oar. Other uses and applications of aspects of the invention will be envisioned by those of skill in the art, and these other uses and applications are understood to be within the purview of the inventions recited herein and claimed below.

While several aspects of the present invention have been described and depicted herein, alternative aspects may be affected by those skilled in the art to accomplish the same objectives. Accordingly, it is intended by the appended claims to cover all such alternative aspects as fall within the true spirit and scope of the invention.

The invention claimed is:

1. An oar carrier and at least one oar comprising:

a panel;

at least one through hole in the panel, the at least one through hole sized to receive a shaft of the at least one oar; and at least one slot in a peripheral surface of the panel, the at least one slot providing open access to the at least one through hole and the at least one slot having a minimum width less than a diameter of the shaft of the at least one oar and adapted to receive the shaft of the at least one oar and allow transfer of the shaft to the through hole.

2. The oar carrier and the at least one oar as recited in claim 1, wherein the at least one through hole in the panel comprises a plurality of through holes in the panel.

3. The oar carrier and the at least one oar as recited in claim 2, wherein the at least one slot in the peripheral surface of the panel comprises a plurality of slots in the peripheral surface of the panel, each of the plurality of slots providing open access to one of the plurality of through holes and each of the plurality of slots having a minimum width less than a diameter of the shaft of the at least one oar and adapted to receive the shaft of the at least one oar and allow transfer of the shaft to one of the plurality of through holes.

4. The oar carrier and the at least one oar as recited in claim 1, wherein the at least one through hole comprises at least one substantially circular through hole.

5. The oar carrier and the at least one oar as recited in claim 4, wherein the at least one substantially circular through hole is sized to receive the shaft of the at least one oar.

6. The oar carrier and the at least one oar as recited in claim 1, wherein the panel comprises a resilient material.

7. The oar carrier and the at least one oar as recited in claim 6, wherein the resilient material comprises a resilient foam rubber material.

8. The oar carrier and the at least one oar as recited in claim 1, wherein a material of the at least one slot comprises a resilient material, wherein the at least one slot having a minimum width less than the diameter of the shaft of the oar is adapted to deflect and allow the diameter of the shaft to transfer to the at least one through hole.

9. The oar carrier and the at least one oar as recited in claim 1, wherein the oar carrier further comprises at least one handle, wherein the at least one handle comprises a through hole in the panel.

10. A method for handling at least one oar, the method comprising:

providing a plurality of oar carriers and at least one oar as recited in claim 1;

inserting a shaft of the at least one oar into the at least one slot of each of the plurality of carriers;

transferring the shaft of the at least one oar through the at least one slot having a minimum width less than a diameter of the shaft of the at least one oar into the at least one through hole in the panel to provide an assembly of the plurality of oar carriers and the at least one oar; and handling the assembly of the plurality of oar carriers and the at least one oar.

11. The method as recited in claim 10, wherein inserting the shaft of at least one oar into the at least one slot of each of the plurality of carriers comprises inserting the shafts of a plurality of oars into a plurality of slots of each of the plurality of carriers.

12. The method as recited in claim 10, wherein transferring the shaft of the at least one oar through the at least one slot into the at least one through hole in the panel comprises deflecting a throat of the at least one slot of each of the oar carriers.

13. The method as recited in claim 12, wherein the method further comprises allowing the deflected throat of the at least one slot of each of the oar carriers to expand and retain the at least one oar in the oar carrier.

14. The method as recited in claim 10, wherein handling the assembly comprises carrying the assembly.

15. An oar carrier and at least one oar comprising:

a panel at least partially comprising a resilient material;

a plurality of through holes in the panel, each of the plurality of through holes sized to receive a shaft of the at least one oar; and a plurality of slots in a peripheral surface of the panel, each of the plurality of slots providing open access through a minimum width of each of the plurality of slots less than a diameter of the shaft of the at least one oar, wherein a portion of the panel having the minimum width of each of the plurality of slots comprises the resilient material adapted to deflect and allow passage of the shaft of the at least one oar to one of the plurality of through holes.

16. The oar carrier and at least one oar as recited in claim 15, wherein the oar carrier further comprises at least one handle.

17. The oar carrier and at least one oar as recited in claim 16, wherein the at least one handle comprises a through hole in the panel.

18. The oar carrier and at least one oar as recited in claim 15, wherein at least one of the plurality of slots comprises a geometry different from at least one other of the plurality of slots.

19. The oar carrier and at least one oar as recited in claim 18, wherein the geometry different from at least one other of the plurality of slots is adapted to facilitate handling of the carrier.

* * * * *